US005669168A

United States Patent [19]

Perry

[11] Patent Number: 5,669,168

[45] Date of Patent: Sep. 23, 1997

[54] FIREARM RECOIL PAD

[76] Inventor: Gregory Richard Perry, 3364 Garden Brook, Dallas, Tex. 75234

[21] Appl. No.: 693,349

[22] Filed: Aug. 6, 1996

[51] Int. Cl.[6] ..... F41C 23/00

[52] U.S. Cl. ..... 42/74; 42/71.04; 42/104; 42/76.02

[58] Field of Search ..... 42/74, 71.01, 104, 42/76.02

[56] References Cited

U.S. PATENT DOCUMENTS

| | | | |
|---|---|---|---|
| 202,606 | 4/1978 | Thornton et al. | 42/74 |
| 779,461 | 1/1905 | Benton | 42/74 |
| 1,774,060 | 8/1930 | Hodge | 42/74 |
| 1,842,527 | 1/1932 | Knight | 42/74 |
| 2,468,349 | 4/1949 | Stewart | 42/74 |
| 2,677,207 | 5/1954 | Stewart | 42/74 |
| 2,885,812 | 5/1959 | Arpin | 42/85 |
| 3,696,544 | 10/1972 | Webb | 42/74 |
| 3,714,726 | 2/1973 | Braun | 42/74 |
| 4,922,641 | 5/1990 | Johnson | 42/74 |
| 5,265,366 | 11/1993 | Thompson | 42/74 |
| 5,461,813 | 10/1995 | Mazzola | 42/74 |

OTHER PUBLICATIONS

Uncle Mikes Recoil Pads.

*Primary Examiner*—Charles T. Jordan
*Assistant Examiner*—Meena Chelliah
*Attorney, Agent, or Firm*—Stephen R. Greiner

[57] ABSTRACT

A recoil pad for universal attachment to firearm stocks of varied size. The recoil pad is a boot, formed of resilient foam material, having a base wall for engagement with the butt of a firearm stock. A retaining sleeve extends from the base wall for engagement with the periphery of a firearm stock. The retaining sleeve has an opening which defines an integral strap portion in the retaining sleeve spaced from the base wall. The integral strap portion may be stretched to accommodate and snugly retain firearm stocks of varied size.

5 Claims, 1 Drawing Sheet

FIREARM RECOIL PAD

FIELD OF THE INVENTION

The present invention relates generally to firearms and, more particularly, to cushioned pads for absorbing firearm recoil shocks.

BACKGROUND OF THE INVENTION

Various devices have been employed for reducing the discomfort resulting from the recoil of a firearm into the body of a user. Recently, foam pads attachable to firearm stocks have been proposed for this purpose. Although these pads are known to be somewhat resilient in their construction, each can only be applied to a firearm stock within a relatively narrow range of sizes. Thus, an owner of several firearms usually requires an equal number of recoil pads. This is an undesirable situation since only one firearm can normally be fired by a user at any given time.

SUMMARY OF THE INVENTION

In light of the problems associated with the prior art devices, it is a principal object of the invention to provide a firearm recoil pad that can be universally attached to all conventional firearm stocks.

It is an object of the invention to provide improved elements and arrangements thereof in a firearm recoil pad which is lightweight, inexpensive to manufacture, and fully effective in absorbing the recoil shocks of rifles and shotguns for example.

Briefly, the firearm recoil pad in accordance with this invention achieves the intended objects by featuring a unitary boot formed from a resilient foam material. The boot includes a base wall for close engagement with the butt of a firearm stock. A retaining sleeve extends from the base wall for engagement with the periphery of the firearm stock. Preferably, the retaining sleeve has an opening which defines an integral strap portion, remote from the base wall, which may be stretched to snugly engage any firearm stock to which it is applied.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
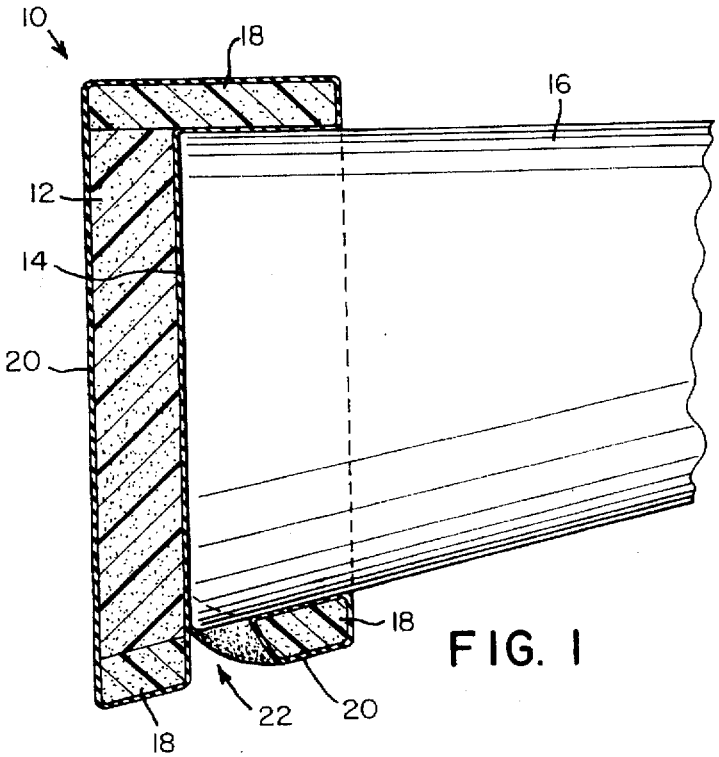
FIG. 1 is a cross-sectional view of a firearm recoil pad in accordance with the present invention attached to a gun stock.
Figure 2:
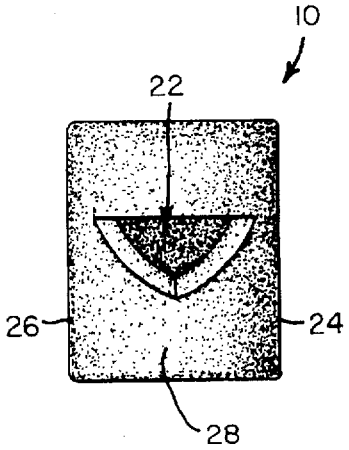
FIG. 2 is a bottom view of the firearm recoil pad of FIG. 1.
Figure 3:
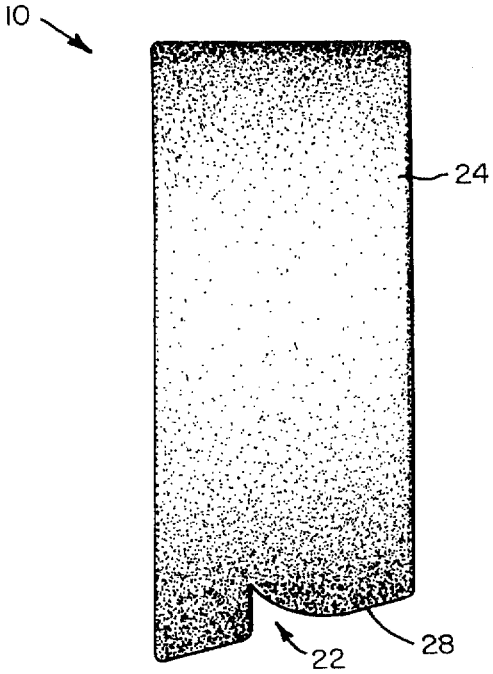
FIG. 3 is a side elevational view of the firearm recoil pad.
Figure 4:
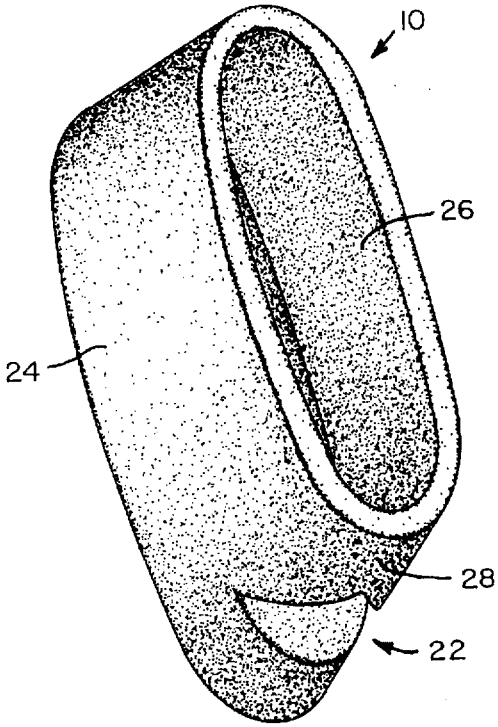
FIG. 4 is a perspective view of the firearm recoil pad.

Referring now to FIGS., a firearm recoil pad in accordance with the present invention is shown at 10. The recoil pad 10 includes a base wall 12 having a generally elliptical shape and size so as to conform to the butt 14 of a firearm stock 16 upon which the recoil pad may be slidably engaged. A retaining sleeve 18 is adhesively secured at one of its ends to the periphery of the base wall 12 so as to form a boot. From its area of attachment to the base wall 12, the retaining sleeve 18 tapers toward its open end to closely conform to all sides of the stock 16.

The base wall 12 and retaining sleeve 18 are preferably die cut from sheets of vinyl nitrile closed-cell foam. Although this material has numerous substitutes, vinyl nitrile closed-cell foam is known for its superior flexibility, resilience and ability to absorb shocks. Thus, a base wall 12 cut from sheets of vinyl nitrile closed-cell foam having a thickness of about ⅞" (2.2 cm) and a retaining sleeve 18 similarly cut from sheets having a thickness of about ⅜" (0.95 cm) have been found ideal for use in the recoil pad 10.

After the retaining sleeve 18 is secured to the base wall 12, a resilient coating 20 is provided to their exposed surfaces. The coating 20 is preferably applied by dipping the united base wall 12 and retaining sleeve 18 into a suitable supply of a polyvinyl chloride coating material so that the recoil pad 10 is entirely coated. Although the preferred coating 20 is only approximately 8 to 10 mil (0.2 to 0.25 mm) in thickness, it substantially increases the life of the enclosed closed-cell foam by hermetically sealing it. The coating 20 also permits the finished recoil pad 10 to be moved with minimal frictional resistance onto a firearm stock.

To accommodate firearm stocks of vastly different dimensions, the retaining sleeve 18 includes an opening 22 at the bottom thereof. The opening 22 is preferably provided in the retaining sleeve 18 at the time the retaining sleeve is cut from closed-cell foam sheet stock. In the undeformed foam stock comprising the retaining sleeve 18, the preferred opening 22 is given a semicircular outline tailored to the shape of most firearm stocks. When deformed during attachment of the retaining sleeve 18 to the base wall 12, however, the originally semicircular opening 22 acquires something of a triangular appearance as shown in the FIGS.

The opening 22 provides the retaining sleeve 18 with a pair of opposed, side portions 24 and 26 joined together by an integral strap portion 28 at the bottom of the recoil pad. Because the strap portion 28, like the remainder of the recoil pad 10, is preferably formed from highly resilient materials, the strap portion may be stretched up to several inches to permit the recoil pad 10 to be positioned on firearm stocks having dimensions significantly larger than those of the stock 16 shown in FIG. 1.

The recoil pad 10 is typically installed by sliding the open end of the coated retaining sleeve 18 onto the stock 16 until the coated base wall 12 engages the butt 14. Since the retaining sleeve 18 has a slightly smaller circumference at its open end than where it contacts the base wall 12, the recoil pad 10 will remain snugly in position on the similarly tapered stock 16 once it is slid into place.

Should it be desired to install the recoil pad 10 upon a firearm stock significantly larger than stock 16, the strap portion 28 of the retaining sleeve 18 may be easily stretched by first engaging it with the underside of the large stock and then lifting the top of the retaining sleeve 18 over the top of the stock. Now, the recoil pad 10 may be slid forward until the coated base wall 12 engages the butt of the firearm.

Later, when the firearm is discharged, the recoil forces will temporarily compress the recoil pad 10. Due to the resiliency of the recoil pad 10, the recoil forces felt by a user are significantly dampened. Of course, after each recoil of the firearm, the pad 10 will return to its uncompressed shape.

While the invention has been described with a high degree of particularity, it will be appreciated by those skilled in the art that numerous modifications and substitutions may be made thereto. For example, any number of openings 22 may be provided in the recoil pad 10 to enhance the ability of the retaining sleeve 18 to stretch and accommodate firearm stocks of very large size. Therefore, it is to be understood that the present invention is not limited to the sole embodiment described above, but encompasses any and all embodiments within the scope of the following claims.

I claim:

1. A firearm recoil pad, comprising:

a base wall formed of a resilient foam material;

a retaining sleeve formed of a resilient foam material secured to said base wall, said retaining sleeve having a pair of integral side portions joined together by a integral strap portion spaced from said base wall; and, said base wall and said retaining sleeve being hermetically sealed by a resilient, protective material.

2. A recoil pad for releasable attachment to a firearm buttstock having a heel and a toe, said recoil pad comprising:

an elongated base wall formed of a resilient foam material and having opposed ends; and, a retaining sleeve formed of a resilient foam material and having a free end and an attachment end, said attachment end being secured to the periphery of said base wall, said retaining sleeve also having an opening flush with one of said opposed ends of said base wall for alternatively receiving therein either the heel or the toe of the buttstock.

3. The firearm recoil pad according to claim 2 further comprising a resilient, protective coating covering said base wall and said retaining sleeve.

4. A recoil pad for releasable attachment to a firearm stock having a butt with a heel and a toe, said recoil pad comprising:

an base wall of a resilient foam material for engagement with the butt of the firearm stock, said base wall being generally elliptical in outline and having narrowed, top and bottom ends; and, a retaining sleeve of a resilient foam material extending from said base wall for engagement with the periphery of the firearm stock, said retaining sleeve including a pair of opposed side portions of like dimensions joined together at their respective bottom edges by an integral strap portion located adjacent said bottom end of said base wall, said strap portion being spaced from said base wall so as to define an opening in said retaining sleeve having a portion of its margin flush with said bottom end of said base wall for receiving the toe of the firearm stock therein.

5. The firearm recoil pad according to claim 4 wherein said base wall and said retaining sleeve are hermetically sealed by a resilient, protective material.

* * * * *